US010718328B2

(12) United States Patent
Helpertz et al.

(10) Patent No.: US 10,718,328 B2
(45) Date of Patent: Jul. 21, 2020

(54) THREADED SPINDLE MACHINE

(71) Applicant: Brinkmann Pumpen K.H. Brinkmann GmbH & Co. KG, Werdohl (DE)

(72) Inventors: Markus Helpertz, Dortmund (DE); Matthias Radermacher, Hückeswagen (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 255 days.

(21) Appl. No.: 15/764,499

(22) PCT Filed: Nov. 3, 2016

(86) PCT No.: PCT/EP2016/076481

§ 371 (c)(1),
(2) Date: Mar. 29, 2018

(87) PCT Pub. No.: WO2017/092958

PCT Pub. Date: Jun. 8, 2017

(65) Prior Publication Data

US 2018/0291893 A1 Oct. 11, 2018

(30) Foreign Application Priority Data

Nov. 30, 2015 (EP) ..... 15196916

(51) Int. Cl.
*F01C 21/00* (2006.01)
*F03C 2/00* (2006.01)
(Continued)

(52) U.S. Cl.
CPC ..... *F04C 2/086* (2013.01); *F04C 2/165* (2013.01); *F04C 15/0003* (2013.01); *F04C 2240/30* (2013.01); *F04C 2240/801* (2013.01)

(58) Field of Classification Search
CPC ..... F04C 2/086; F04C 2/165; F04C 15/0003; F04C 2230/90; F04C 2230/91; F04C 2230/92; F04C 2240/30; F04C 2240/801
(Continued)

(56) References Cited

U.S. PATENT DOCUMENTS 3,289,649 A * 12/1966 Lamm ..... F04C 2230/92 418/178
3,354,537 A 11/1967 O'Connor
2012/0288395 A1* 11/2012 Wagner ..... F04C 2230/92 418/178

FOREIGN PATENT DOCUMENTS

CN 2345737 Y 10/1999
CN 101307674 B 12/2010
WO 2009/012837 A1 1/2009

* cited by examiner

*Primary Examiner* — Theresa Trieu
(74) *Attorney, Agent, or Firm* — Richard M. Goldberg

(57) ABSTRACT

A threaded spindle machine includes a metal middle housing part (12) arranged between housing end caps (24) and forming a fluid chamber (16) for receiving a plurality of threaded spindles rotatably supported in the housing end caps (24); an insert (18) adhered into the middle housing part, which insert forms a wear-resistant running surface for the threaded spindles on the inner wall of the fluid chamber (16) and defines an adhesive gap (20) with the inner surface of the middle housing part (12); and at least one filling channel (26) leading from an outer surface of the middle housing part (12) to the adhesive gap (20), and the filling channel (26) extends from an end of the middle housing part (12) which is adjacent to a housing end cap (24).

9 Claims, 2 Drawing Sheets

(51) Int. Cl.

| | |
|---|---|
| ***F03C 4/00*** | (2006.01) |
| ***F04C 2/08*** | (2006.01) |
| ***F04C 2/16*** | (2006.01) |
| ***F04C 15/00*** | (2006.01) |

(58) Field of Classification Search
USPC ..... 418/178–179, 205, 206.1–206.9
See application file for complete search history.

THREADED SPINDLE MACHINE

BACKGROUND OF THE INVENTION

The invention relates to a threaded spindle machine comprising a metal middle housing part arranged between housing end caps and forming a fluid chamber for receiving a plurality of threaded spindles rotatably supported in the housing end caps; an insert adhered into the middle housing part, which insert forms a wear-resistant running surface for the threaded spindles on the inner wall of the fluid chamber and defines an adhesive gap with the inner surface of the middle housing part; and at least one filling channel leading from an outer surface of the middle housing part to the adhesive gap.

WO 2009/012837 A1 describes a threaded spindle machine of this type, e.g. a screw spindle pump or a screw spindle compressor. The middle housing part is formed by two metal half shells firmly clamped together and each forming one half of the fluid chamber. The wear resistant layer at the inner surface of the fluid chamber is formed by a silicon carbide insert adhered therein. During manufacture the insert is held in the fluid chamber such that it forms at its periphery an adhesive gap with the middle housing part, and adhesive is injected into the adhesive gap through the filling channel, so that the insert is firmly held in the middle housing part when the adhesive has cured.

The filling channel leads from the peripheral surface of the middle housing part radially inwardly to the adhesive gap.

SUMMARY OF THE INVENTION

It is an object of the invention to provide a threaded spindle machine with improved leak-proofness.

In order to achieve this object, according to the invention, the filling channel is arranged to extend from an end of the middle housing part that is adjacent to one end cap.

This has the advantage that, in the fully assembled state, the outer opening of the filling channel is covered by the housing end cap that is present there, whereby a sealing of the filling channel is facilitated. For example, the filling channel extends in axial direction of the housing from the end face of the middle housing part into the region of the adhesive gap which then cuts into the filling channel.

In the threaded spindle machine according to the invention, leakage is reliably avoided by the improved sealing of the opening of the filling channel.

Useful details and further embodiments of the invention are indicated in the dependent claims.

In an advantageous embodiment a circumferential seal is provided between the end face of the middle housing part which contains the opening of the filling channel and the adjacent housing end cap, the seal extending outside of the cross-section of the fluid chamber but including also the opening of the filling channel, whereby a particular effective sealing of the filling channel is achieved.

BRIEF DESCRIPTION OF THE DRAWINGS

An embodiment example will now be described in conjunction with the drawings, wherein.

DETAILED DESCRIPTION

Figure 1:
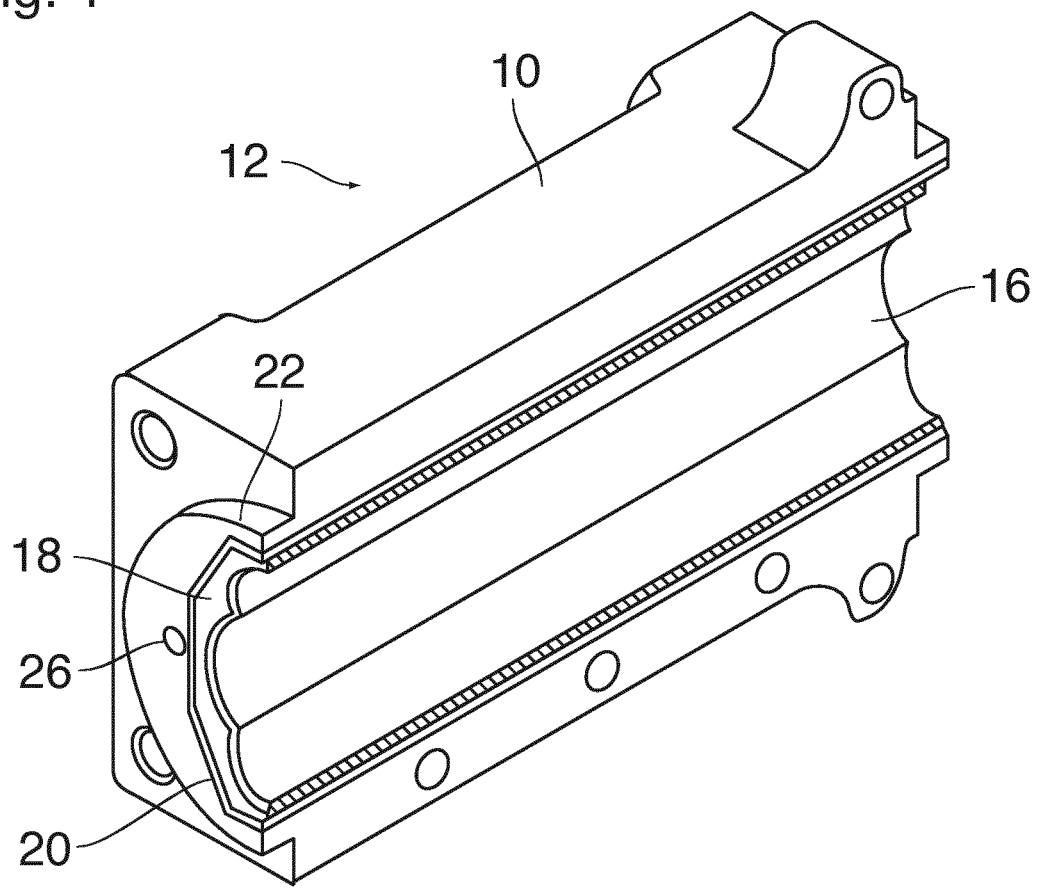
FIG. 1 is a partly sectioned perspective view of a part of a housing of a threaded spindle machine.

A half-shell 10 of a middle housing part 12 of a threaded spindle machine has been shown in FIG. 1. The half-shell 10 and another half-shell 14 (FIG. 2) that is complementary thereto are formed by cast metal and are assembled to form the complete middle housing part 12 and are fixed at one another by means of bolts, for example. In another embodiment the middle housing part may be formed in one piece. Inside the middle housing part 12, a fluid chamber 16 is formed which extends over the entire length of the middle housing part and has a uniform cross-section on its entire length. As can be seen more clearly in FIG. 2, the cross-section of the fluid chamber 16 is formed by three overlapping circles among which the middle one has a larger diameter than the two other circles. In the completed threaded spindle machine, the fluid chamber 16 accommodates three parallel threaded spindles that mesh with one another and the enveloping circles of which correspond respectively to one of the three circles of the cross-section.

The inner surface of the fluid chamber 16 is formed by an insert 18 of wear-resistant ceramics, e.g. silicon carbide.

The insert 18 has a cross-section with an octahedral outer contour and forms an adhesive gap 20 with a complementary inner contour of the half-shells 10, 14.

Figure 2:
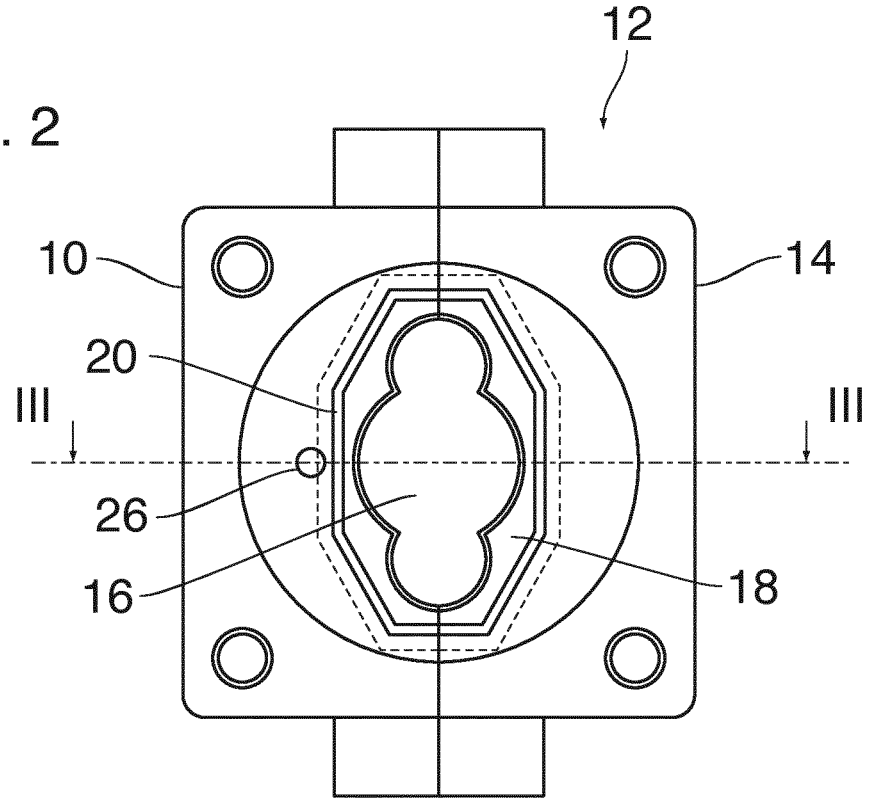
FIG. 2 is an end view of a middle part of the housing.

As has been shown in phantom lines in FIG. 2, the adhesive gap 20 inside the middle housing part 12 has a somewhat larger external cross-section than at the opposite ends.

The middle housing part 12 has at each of its opposite ends a respective cylindrical centering section for an end cap 24 (FIG. 3) that tightly adjoins the middle housing part. In FIG. 2, one end of a filling channel 26 is visible in the end face of the centering section 22, the filling channel extending closely to but outside of the end of the adhesive gap 20 into the interior of the middle housing part 12 at the level of the left vertex of the fluid chamber 16 in FIGS. 1 and 2 and then, further inwardly, cuts into an enlarged part of the adhesive gap, as can be seen in FIGS. 2 and 3.

Figure 3:
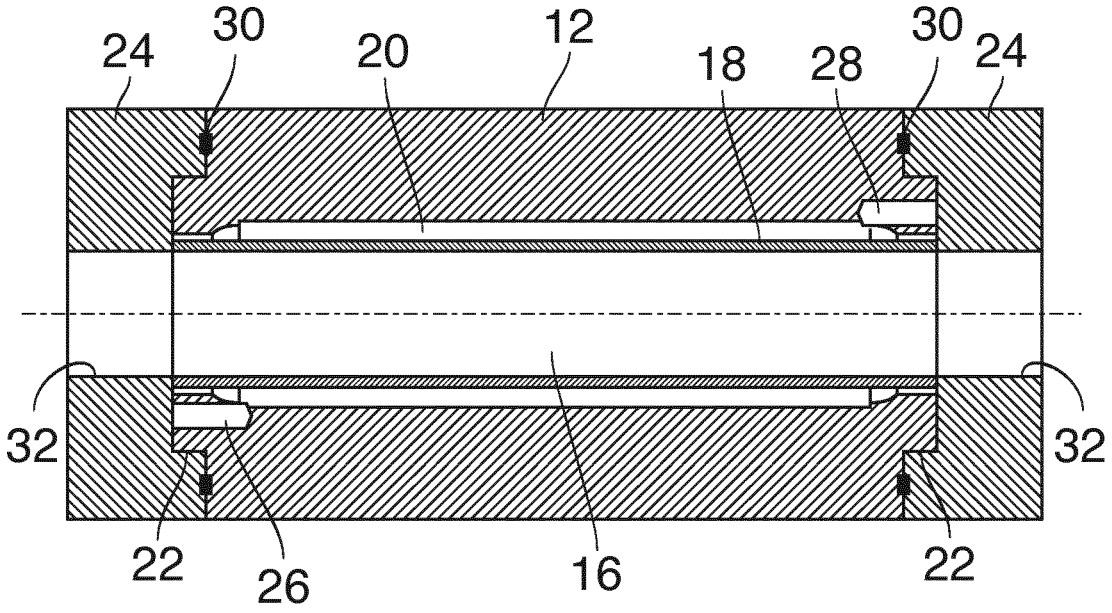
FIG. 3 is a sectional view taken along the line in FIG. 2.

At the right end of the housing in FIG. 3, a vent channel 28 is formed in analogous manner and cuts into the opposite vertex of the fluid chamber 16.

In the end faces of the middle housing part, both the opening of the filling channel 26 and the opening of the vent channel 28 are located outside of the outer contour of the adhesive gap.

Circumferential seals 30 are provided in the end faces of the middle housing part 12 and the corresponding end faces of the housing end caps 24, said seals extending radially outside of the filling channel 26 and the vent chamber 28 and, in the example shown, also outside of the respective centering sections 22.

The inner surface of the insert 18 forms, together with corresponding bores 32 in the housing end caps 24, an inner contour for accommodating the threaded spindles which have not been shown here and are rotatably supported and sealed pressure-tight in the end caps 24.

When, during operation of the threaded spindle machine, a high-pressure medium enters from the fluid chamber 16 through the joint between the middle housing part 12 and the housing end caps 24 or via shrink holes in the cast material into the adhesive gap 20, this fluid is restrained at the seals 30 at the latest, so that leakage can be prevented reliably.

Figure 4:
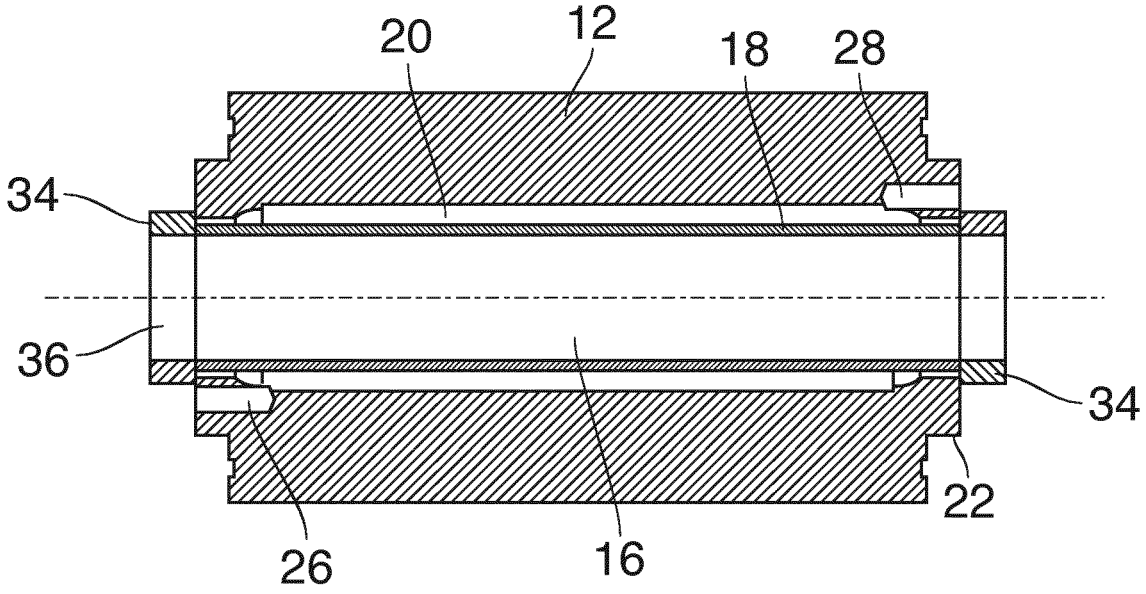
FIG. 4 is a sectional view analogous to FIG. 3 but shows a condition when an insert is adhered into the middle housing part.

FIG. 4 shows an intermediate state during the manufacture of the threaded spindle machine.

Here, in place of the housing end caps 24, locking blocks 34 have been set against the opposite end faces of the centering sections 22. These locking blocks 34 close-off the open ends of the adhesive gap 20. Similarly as the housing end caps 24, the locking blocks 34 have bores 36 for the threaded spindles.

In the condition shown in FIG. 4, the adhesive gap 20 can be filled with adhesive via the filling channel 26 while the displaced air is vented via the vent channel 28. When the adhesive has cured, the locking blocks 34 may be removed, and the housing may be finished as shown FIG. 3, whereby the housing end caps 24 assure a reliable sealing of the filling channel 26 and the vent channel 28.

What is claimed is:

1. A threaded spindle machine comprising:

a metal middle housing part arranged between housing end caps and forming a fluid chamber therein for receiving a plurality of threaded spindles rotatably supported in the housing end caps;

an insert adhered into the middle housing part, which insert forms a wear-resistant running surface for the threaded spindles on an inner wall of the fluid chamber and defines an adhesive gap with an inner surface of the middle housing part;

at least one filling channel leading from an outer surface of the middle housing part to the adhesive gap, the filling channel extending from an end of the middle housing part which is adjacent to one of the housing end caps; and a circumferential seal at the end of the middle housing part at which the filling channel is located, said seal enclosing the end of the fluid chamber as well as the end of the filling channel.

2. The threaded spindle machine according to claim 1, wherein the adhesive gap inside of the middle housing part has an outer cross-section which is larger than an outer cross-section thereof at opposite ends of the middle housing part, and the filling channel cuts into the larger outer cross-section of the adhesive gap.

3. The threaded spindle machine according to claim 1, wherein the filling channel extends from an end face of a centering section of the middle housing part, with the one of the housing end caps being plugged onto said centering section.

4. A threaded spindle machine comprising:

a metal middle housing part arranged between housing end caps and forming a fluid chamber therein for receiving a plurality of threaded spindles rotatably supported in the housing end caps;

an insert adhered into the middle housing part, which insert forms a wear-resistant running surface for the threaded spindles on an inner wall of the fluid chamber and defines an adhesive gap with an inner surface of the middle housing part; and at least one filling channel leading from an outer surface of the middle housing part to the adhesive gap, the filling channel extending from an end of the middle housing part which is adjacent to one of the housing end caps;

wherein the middle housing part includes a vent channel which communicates with the adhesive gap and extends from an end of the middle housing part adjacent to one housing end cap.

5. The threaded spindle machine according to claim 4, wherein the filling channel and the vent channel are provided at opposite ends of the middle housing part.

6. The threaded spindle machine according to claim 4, wherein the filling channel and the vent channel are provided at opposite vertices of the fluid chamber.

7. The threaded spindle machine according to claim 4, wherein the filling channel extends along an axial direction of said middle housing part, and each of the filling channel and the vent channel extend in directions parallel to said axial direction.

8. The threaded spindle machine according to claim 4, wherein the adhesive gap inside of the middle housing part has an outer cross-section which is larger than an outer cross-section thereof at opposite ends of the middle housing part, and the filling channel cuts into the larger outer cross-section of the adhesive gap.

9. The threaded spindle machine according to claim 4, wherein the filling channel extends from an end face of a centering section of the middle housing part, with the one of the housing end caps being plugged onto said centering section.

* * * * *